US011845176B2

(12) United States Patent
Søderstrøm

(10) Patent No.: US 11,845,176 B2
(45) Date of Patent: Dec. 19, 2023

(54) FINGER MOUNTABLE TOOL HOLDER

(71) Applicant: Kataz ApS, Aarhus C (DK)

(72) Inventor: Dennis Søderstrøm, Galten (DK)

(73) Assignee: Kataz ApS, Aarhus C (DK)

( * ) Notice: Subject to any disclaimer, the term of this patent is extended or adjusted under 35 U.S.C. 154(b) by 296 days.

(21) Appl. No.: 16/641,997

(22) PCT Filed: Aug. 13, 2018

(86) PCT No.: PCT/DK2018/050195
§ 371 (c)(1),
(2) Date: Feb. 25, 2020

(87) PCT Pub. No.: WO2019/037825
PCT Pub. Date: Feb. 28, 2019

(65) Prior Publication Data

US 2020/0290193 A1 Sep. 17, 2020

(30) Foreign Application Priority Data

Aug. 25, 2017 (DK) ..... PA201770638

(51) Int. Cl.
*B25G 1/10* (2006.01)
*B25B 5/04* (2006.01)
(Continued)

(52) U.S. Cl.
CPC ..... *B25G 1/107* (2013.01); *B25B 5/04* (2013.01); *B26B 5/00* (2013.01); *B26B 27/007* (2013.01)

(58) Field of Classification Search
CPC ..... B25G 1/107; B25G 1/102; B25B 5/04; B26B 5/00; B26B 27/007; B26B 21/527
(Continued)

(56) References Cited

U.S. PATENT DOCUMENTS 224,975 A 2/1880 White
1,701,057 A * 2/1929 Thatcher ..... A44C 5/0046 24/339
(Continued)

FOREIGN PATENT DOCUMENTS

CN 203156777 U 8/2013
CN 204525554 U 8/2015
(Continued)

OTHER PUBLICATIONS

International Preliminary Report on Patentability (IPRP) for Application No. PCT/DK2018/050195, dated Jul. 25, 2019 in 16 pages.
(Continued)

*Primary Examiner* — Eric J Rosen
*Assistant Examiner* — J Stephen Taylor
(74) *Attorney, Agent, or Firm* — Knobbe, Martens, Olson & Bear, LLP

(57) ABSTRACT

The present invention relates to a device for mounting a tool on a hand of a user, the device comprises a receiving part for attachment of a tool and at least one mounting member for mounting the device on one or more fingers of the hand of the user, such as two neighbouring fingers, wherein the receiving part is fixed to the mounting member, and the receiving part comprises at least one clamp for clamping a tool to the device, wherein the clamp has a closed position (h2) and an open position (h1) and wherein the clamp is configured to be operable by one or more of the fingers of the same hand the device is mounted on. The invention further relates to a method of mounting a tool in the device, and to the use of the device.

19 Claims, 3 Drawing Sheets

(51) Int. Cl.
*B26B 5/00* (2006.01)
*B26B 27/00* (2006.01)

(58) Field of Classification Search
USPC ..... 81/3.41, 44, 177.3
See application file for complete search history.

(56) References Cited

U.S. PATENT DOCUMENTS 1,727,286 A 9/1929 Hamre
1,971,814 A * 8/1934 Genda ..... B26B 27/007 30/232
2,353,557 A 7/1944 Guthrie
2,543,283 A 2/1951 Frank
3,913,643 A 10/1975 Lambert
4,467,873 A 8/1984 Kaatz
5,791,705 A * 8/1998 Romero ..... A61F 4/00 30/298
6,138,976 A * 10/2000 Fahringer, Sr. ..... A01K 97/10 248/205.2
6,328,494 B1 * 12/2001 Moxon ..... B43K 5/005 206/374
6,378,745 B1 * 4/2002 De Luccia ..... A45F 5/00 224/232
6,669,388 B1 12/2003 Short
2007/0028727 A1 2/2007 Schiller
2007/0095991 A1 * 5/2007 Fall ..... A45F 5/02 248/229.26
2017/0238633 A1 8/2017 Fu

FOREIGN PATENT DOCUMENTS

EP 0266699 A2 5/1988
GB 2332617 A 6/1999
GB 2426946 A 12/2006
WO 2016192743 A1 12/2016

OTHER PUBLICATIONS

International Search Report for Application No. PCT/DK2018/050195, dated Jul. 25, 2019 in 3 pages.

* cited by examiner

FINGER MOUNTABLE TOOL HOLDER

CROSS-REFERENCE TO RELATED APPLICATIONS

This application is the U.S. National Phase under 35. U.S.C. § 371 of International Application PCT/DK2018/050195, filed Aug. 13, 2018, which claims priority to Danish Patent Application No. PA201770638, filed Aug. 25, 2017. The disclosures of the above-described applications are hereby incorporated by reference in their entirety.

FIELD OF THE INVENTION

The invention relates to a device for attachment of a tool and for being mounted on fingers of a user, a method for securing a tool in the device and for the use of the device.

BACKGROUND

In handling and using a tool it is of significant advantage that the user can operate the tool using only a minimum amount of hands and fingers of the user, such that the hands and fingers may readily be employed in different work operations. Several work operations may need to take place within a short period of time, and a finger-mounted hand tool can thereby facilitate a more effective work process.

For these specific circumstances it is known to employ a finger-mounted tool, which for example extends the functional extent of one or more fingers, e.g. Patent document no. GB2332617 A shows a finger mountable tool, e.g. a toothbrush which allows the user to reach and clean even the narrowest and hidden places within the mouth. The tool extends beyond the finger tip of the finger and restricts the functional use of that finger for different work tasks.

Patent document no. US 2007/0028727 A1 describes a tool handle having apertures for receiving fingers of a user's hand. The tool handle can be connected to different tools such as a wrench, so that the tool is arranged as an extension to the handle i.e. in parallel or it may also be connected to the handle at an angle.

Patent document no. WO 2016/192743 describes a tool handle to be connected with a tool, e.g. a shaving head and mounted on one or more fingers, using ring-shaped openings. The shaver is shown orientated along the longitudinal extent of the fingers.

Patent document no. CN203156777U describes a finger-mountable part on which a replaceable shaving blade can be arranged in a recess such that the shaving blade is orientated perpendicularly to the longitudinal extent of the fingers.

U.S. Pat. No. 2,353,557 describes a knife, which is arranged on the dorsum of a hand, e.g. attached to a glove, so that the knife blade is pointing towards the fingertips of the fingers when in an outstretched configuration. The knife blade is orientated such that it stands perpendicular to the dorsum of the hand.

Patent document no. CN20452554U describes a device having a finger-mountable part, which may be resilient and comprise straps, on which part a knife blade can be attached for cutting paper or the like. The knife blade is arranged such that the blade extends transversely across the fingers around which the device is mounted and such that the knife blade stands perpendicularly on the upper side of the fingers.

The object of the present invention relates at least to providing a finger mountable tool holder which eases the work task to be accomplished, and which facilitates time-saving and effective execution of the work task while minimizing the limitation on the functionality of the fingers of the hands on which the device is mounted, such that the user can readily and quickly switch between different work operations using the tool or using the fingers of the hand.

THE DESCRIPTION OF THE INVENTION

The first aspect of the invention relates to a device for mounting a tool on a hand of a user, the device comprises a receiving part for attachment of a tool and at least one mounting member for mounting the device on one or more fingers of the hand of the user, such as two neighbouring fingers, wherein the receiving part is fixed to the mounting member, and the receiving part comprises at least one clamp for clamping a tool to the device, wherein the clamp has a closed position (h2) and an open position (h1) and wherein the clamp is configured to be operable by one or more fingers of the same hand the device is mounted on.

Advantageously, the present invention facilitates holding and operating hand tools which are normally handheld when in use. This means that the invention provides an extra helping hand in the sense that, the tool is in a position to be used, while allowing the fingers and hands to remain available to be used in other work tasks. The device allows for easy and fast changeover to and from using the mounted tool.

Additionally, the device also advantageously prevents the common problem within the technical field of storing the hand tool in the mouth of the user, which commonly happens, when the hands are needed for intermediate tasks in between using the hand tool. Due to the present invention, the hand tool does not need to be temporarily stored in the mouth, a pocket or a toolbox, but may instead by stored on the hand of the user, ready to be used in this position.

Due to the mechanism of the clamp, the clamp can be operated to accommodate tools with a wide range of different shapes and sizes. The tool may be e.g. a flash-light, pen, pencil, knife, measuring device, scratching tool or other hand tools. The tool may also be a cosmetic tool, imaging instruments or other instruments or tools which may be utilized, when mounted on the hand of the user.

The clamp exerts a force on the tool, which is sufficiently strong to be able to secure the tool in the desired position, while simultaneously being low enough to be altered by one or more fingers of the user, such that the force on the tool can be released and the tool can be moved. The device provides a simplistic, quick and easy way of mounting and removing any tools on the hand of the user.

With the expression "clamp" it is understood, that a clamp is a fastening tool, which can temporarily hold and secure an object e.g. a tool such as a hand tool tightly together to a degree sufficient for the secured object to be used in a work task.

The clamp may originally be in a closed position (h2), prior to being in use. The clamp may preferably be transferred into the open position (h1) by biasing the clamp using one or more fingers of the hand on which the device is mounted but not enclosed by the mounting member. As the clamp is biased into the open position (h1), the clamp is arranged to allow the tool to be placed in the clamp. The clamp may preferably comprise an elastic part, such that the clamp may be capable of recovering the closed position (h2) after being biased into the open position (h1). As the applied force by the one or more fingers is released, the clamp may try to restore the original closed position (h2), whereby the clamp may provide a holding force on the tool placed in the clamp as it applies an inward force and thereby prevent dislocation and movement of the tool.

The receiving part may be fixed at any orientation on the mounting member. In one or more embodiments, the orientation of the tool in the receiving part is dependent on the orientation of the clamp. The clamp may be arranged such that the tool is arranged in parallel or perpendicular to the longitudinal extent of the fingers in a stretched out configuration. In some cases it can be of advantage that the tool does not protrude excessively outward from the dorsum of the hand, and the clamp can be orientated to accommodate this.

Advantageously, the device allows for simple placement of the tool into a secured position using a simple mechanism in form of a clamp. The clamp may preferably comprise clamp wall(s) with clamp opening(s) allowing access to an interior clamp space enclosed by the clamp wall(s).

In one or more embodiments, the clamp may have one clamp opening comprised of two opposing side openings and a longitudinal top opening connecting the two opposing side openings e.g. a clamp structure having a substantially U-shaped or C-shaped cross-section. The clamp may e.g. be made of a U-shaped bend clamp wall material e.g. spring steel enclosing a clamp space and having a top clamp opening to the enclosed space of the clamp which is directed away and positioned a distance away from the dorsum side of the hand and two clamp openings at two opposing sides of the clamp. The clamp is preferably in connection with the mounting member such that the free ends of the clamp wall are directed away from the mounting member. The clamp may be placed in an open position (h1) by increasing the clamp opening(s) and the interior space by moving at least a part of clamp wall in a direction away from the interior space, using force applied by one or more fingers. As the force is released, the clamp wall is configured such that the moved part of the clamp wall will try to regain its original equilibrium position and with a tool in the interior space, larger than the original size of the interior space, the wall will exert a force onto the tool and thereby secure the tool in the receiving part.

In one or more embodiments, the clamp may be cylinder shaped and have two oppositely arranged clamp openings allowing for placing a tool, e.g. a cylindrical tool, inside the clamp, in the interior space enclosed by the clamp wall. The longitudinal extent of the cylinder shaped clamp is preferably orientated in parallel to the plane defined by the longitudinal extend of the fingers when stretched. A part of the cylinder wall surface is preferably in connection with the mounting member. The diameter of the clamp openings may be increased by forcing at least a part of the clamp walls of the cylinder in a direction away from the interior space so as to increase the diameter and allow the tool to be placed in the interior space of the clamp. After releasing the force on the clamp wall, the clamp wall may preferably be configured to bounce back to its original position and thereby exert a holding force on the tool in the interior space as the tool is larger than the original interior space.

The size of the clamp opening(s) and the size of the clamp space may be continuously increased as the clamp wall(s) is continuously moved away from the centre of the interior clamp space. The movement of the clamp wall(s) may be stopped when the clamp opening(s) and clamp space are big enough to receive the tool. Padding may be provided in the interior clamp space for aiding in holding particularly small tools.

Within this description, the first finger of the hand of the user is the thumb, the second finger is the index finger, the third finger is the middle finger, the fourth finger is the ring finger and the fifth finger is the pinky finger. The hand has a dorsum side which is the back of the hand and a palm which is the front inner side of the hand. It is understood that within this disclosure, references made to a wrist or arm of the user relates to the wrist and the arm arranged in connection with the hand on which the device is mounted.

In one or more embodiments, the mounting member may be arranged around or on the back or front side of a single finger, such as the index finger. In a preferred embodiment, the mounting member is configured to mount the device on the back side of or around the third and the fourth finger of the hand of the user. Preferably the mounting member is mounted between finger joints of the finger(s) such that the finger(s) on which the device is mounted may be utilized for other work task which does not involve the device according to the invention.

Attaching the device to fingers of the hand allows for an easier control and larger precision of movements of the device and thereby the tool due to the motor function of the fingers and wrist compared to the arm. The mounting member may be any adjustable band, belt or strap.

An engagement of the tool in a work task may be facilitated by moving the hand and/or the whole arm of the user in any direction. In one or more embodiments, the receiving part may be arranged on the dorsum side of the hand such that tool arranged in the receiving part may engage in a work task by pivoting the wrist of the user about an axis perpendicular to the longitudinal extent of the arm along a movement substantially directed from the palm-side of the hand to the dorsum-side of the hand, or opposite. This direction of movement and the mounted position of the device on the dorsum side of the hand is optimal for generating sufficient momentum and force by the hand, arm and/or wrist of the user.

In one or more embodiments, the device is configured to be mounted on the proximal finger parts of at least two neighbouring fingers. The placement of the device on the proximal finger parts makes it easier for the user to transfer the required momentum and force to the tool when in use. The two neighbouring fingers may be the third and the fourth finger, whereby the second and fifth fingers may be utilized for operating the clamp. The mounting member may be adapted to be mounted using a single strap, belt or band, which extends fully or partly around both proximal finger parts.

In one or more embodiments, the clamp is configured to be biased into the open position (h1) by using at least one finger which is neighbouring at least one of the fingers on which the device is mounted. The biasing of the clamp is executed by a finger which is not enclosed the mounting member, but which may be neighbouring the mounted finger(s) and thereby may be free to move and operate the clamp, by applying a force on the clamp and biasing it into the open position (h1). Preferably, the clamp is placed in an open position (h1) by engaging the finger with the clamp and applying a downward directed force from the dorsum of the hand towards the palm of the hand.

In one or more embodiments, the clamp comprises at least two opposing clamping surfaces for retaining the tool in the device, and wherein the clamp is configured to be biased into the open position (h1) by separating the clamping surfaces by using at least one finger which is neighbouring at least one of the fingers on which the device is mounted. When unaffected, in the closed position (h2) the clamping surfaces may be having an original separation spacing between them. The clamping surfaces may or may not be in contact when the clamp is in the closed position (h2). The clamping surfaces are preferably at least a part of the surfaces in direct contact with the tool when the tool is secured in the clamp, and the movement of the clamping surfaces allows the control of the direct contact and also the force exerted on the tool due to e.g. elastic properties of the clamp. The position of one of the clamping surfaces may remain unaltered while the opposing clamping surface is moved until the clamp is in the open position (h1) allowing a tool to be placed in the clamp or removed from the clamp. Alternatively, each clamping surface may be moved by neighbouring fingers to place the clamp into the open position (h1).

In one or more embodiments, the receiving part comprises at least one engagement member made of a rigid material and attached to the clamp, such that the clamp is operable via the engagement member. The engagement member may be plate shaped or rod shaped or of other suitable shapes and made of a rigid and preferably a substantially non-flexible material. The engagement member may be attached to the clamp such that the clamp may be biased into the open position (h1) via a force applied to the engagement member. The rigidity of the engagement member advantageously makes it possible to transfer the required force applied on the engagement member by the finger to the clamp on which the engagement member is attached.

In one or more embodiments, the engagement member is positioned such that it is reachable by a finger, e.g. an index finger, neighbouring at least one of the fingers on which the device is mounted. The engagement member may be any shape and size and extending outwards from the clamp, and preferably in a direction towards one or more fingers of the hand, which is neighbouring the fingers on which the device is mounted. The engagement member may extend directly above the finger for operating the clamp, such that it is readily reachable by the finger. The engagement member may comprise a part, configured to provide a good grip for the finger, when the finger is engaging with the engagement member. The position of the engagement member advantageously makes it possible for the finger to apply the required force for biasing the clamp via the engagement member to an open position (h1) sufficient for placing a tool in the receiving part or for removing a tool from the receiving part. The finger for operating the clamp may preferably apply the force in a direction toward the palm of the hand, whereby the engagement member is also moved in a direction toward the palm of the hand, which in turn places the clamp into the open position (h1).

In one or more embodiments, the engagement member is configured to be angularly moved about a pivotal point whereby the clamp is placed in the open position (h1). The engagement member and the clamp may be mutually attached in such a configuration, whereby the clamp is placed into an open position as the engagement member is rotated about a pivotal point, where the pivotal point may be located in the plane comprising the contact interface between the receiving part and the mounting member. The pivoting of the engagement member may move at least a part of the clamp wall outwardly in a direction away from the interior clamp space or away from the equilibrium position of the clamp wall, thereby opening the clamp. Advantageously, the pivoting movement of the engagement member, substantially along semi-circular path, allows for a larger and more secure control of the engagement member and thereby the clamp between the open position (h1) and closed position (h2).

In one or more embodiments, the receiving part comprises one clamp and two engagement members. The clamp may be biased at two parts of the clamp walls, e.g. near two opposing parts of the clamp walls, such that more than one part of the clamp may be biased. Furthermore the necessary force for placing the clamp in an open position may be applied by two fingers instead of one, reducing the force which needs to be generated per finger to operate the clamp. The fingers operating the clamp may be located on each side of the device and neighbouring the fingers on which the device is mounted.

In one or more embodiments, each clamping surface is configured to be moved via at least one engagement member. The device may comprise an engagement member attached near each clamping surface, i.e. a clamp having two opposing clamping surfaces may have two engagement members. The clamp may be biased such that each clamping surface is moved by a finger neighbouring a finger on which the device is mounted via an engagement member. The clamping surfaces are preferably moved away from each other in order to place the clamp in an open position (h1).

In one or more embodiments, the device comprises a knife tool, comprising a knife blade having a cutting edge, and wherein the knife tool is clamped to the receiving part by the clamp. The knife blade has two opposing surfaces where the extents of the surfaces are much larger than the thickness of the blade. A cutting edge is located along at least a part of the rim of the blade. The knife tool may be removably retained in the clamp e.g. between two clamping surfaces, applying a force on each surface of the blade due to e.g. elastic properties of the clamp. The cutting edge may be orientated along or at an angle to the longitudinal extent of the fingers.

In one or more embodiments, the knife tool is mounted such that at least a point of the cutting edge of the knife blade is exposed and directed forwardly towards the tip of the fingers of the hand on which the device is mounted when the fingers are stretched out. The exposed cutting edge may comprise two cutting edge parts joined at one end at an angle such that a pointed shape is created e.g. a triangular shape. The pointed shape may be pointing in a direction along the longitudinal extent of the fingers when stretched out, such that e.g. when making a fist, the pointed shape can engage with an object and may make a cut upon pivoting the first about a pivot point at the wrist. Advantageously, this orientation of the cutting edge facilitates an optimum and significant force transfer from the user to the tool. The exposed part may preferably be used for cutting objects, such as paper, straps, cardboard etc.

In one or more embodiments of the present invention, the receiving part may comprise a protection element having a movable shield attached to a spring element, wherein the movable shield is configured to move along the longitudinal extent of the fingers and/or the cutting edge, such as to cover or expose at least a part of the cutting edge of the knife blade. The shield may also be arranged to cover or expose a functional part of a different type of tool. The protection element comprises an open and closed position, wherein in the open position the spring element is configured to be compressed and where in the closed position the spring element is configured to be resting.

In one or more embodiments of the first aspect of the invention, the mounting member comprises a band of plastic or metal, such as an aluminium band, bent to sufficiently enclose one or more fingers or two fingers, such as the collective circumference of two neighbouring fingers. The mounting member may comprise a mouldable metal or plastic band material which can be partly deformed to fit around the finger(s), such that the band may fit to all finger sizes. The band may have a substantially C-shaped cross-sectional shape with a width large enough to allow the mounting member to fit securely on the finger(s), even when the hand is provided with a glove. Advantageously, the material is deformable enough to allow the device to be mounted tightly around the finger(s) but also rigid enough to allow fixation of the device on the finger(s), such that the position of the device and the tool mounted in the device is unaltered when in use.

In one or more embodiments of the first aspect of the invention, the mounting member comprises a strap, such as a flexible strap, or such as a hook and loop fastening strap for securing the device onto one or more fingers of the user or two fingers of the user. The strap may preferably be adjustable such that it may enclose one, two, three or four fingers and different sizes of fingers. Preferably, due to the flexibility of the flexible strap e.g. a strap made of rubber and the effectiveness of the hook and loop fastener, the straps allow for a tight fit of the device on the finger(s).

In one or more embodiments of the first aspect of the invention, the mounting member encloses at least a part of proximal finger parts of two neighbouring fingers. The mounting member may be configured to form a single loop enclosing both finger parts of the neighbouring fingers.

In one or more embodiments of the first aspect of the invention, the mounting member comprises a support region extending over at least a part of the finger(s) on which the device is mounted. Additionally or alternatively, the mounting member may comprise a support region extending along a direction parallel to the transverse plane dividing the mounting member and the receiving part. The support region may be made of an impact-resistant material such as metal or hard plastic or the like and may further provide the connecting link between the mounting member and the receiving part, e.g. the clamp may be directly fastened onto the support region. Advantageously, the support region provide a rigid plate, which acts to stabilize and maintain the position of receiving part and thereby the tool on the finger(s). The support region may comprise a substantially curved support region surface accommodating the curved surface of the finger(s), such that a part of the support region extends along a small part of the side of the finger(s), and prevent possible rotation of the device e.g. rotation of the clamp about the longitudinal extent of the finger(s).

In one or more embodiments of the first aspect of the invention, at least a part of the support region is shaped to be positioned between two neighbouring fingers such as to prevent rotation of the mounting member about an axis parallel to the longitudinal extent of the fingers. The support region may comprise a protruding part partially or fully extending in between the neighbouring fingers, e.g. the support region may have a support region surface facing the fingers which is substantially M- or V-shaped, such that the middle point of the shape protrudes at least partially in between the fingers. Advantageously, this support region shape facilitates a more stable mounting of the device, whereby rotation and dislocation is prevented.

The third aspect of the invention relates to a method for retaining a tool to a device, wherein the device comprises a mounting member for fixing the device on one or more fingers and a receiving part for holding the tool, wherein the receiving part is fixed to the mounting member, and the receiving part comprises at least one clamp for clamping a tool to the device, the clamp comprises at least two clamping surfaces, and an open position (h1) and a closed position (h2), wherein in the open position (h1) the clamp facilitates placing a tool into the clamp or removing a tool from the clamp, and wherein the closed position (h2) facilitates securely retaining the tool in the receiving part, Wherein the method comprises the steps of:

Mounting the device on one or more fingers of a hand of the user via the mounting member, such that the receiving part is positioned on the dorsum side of the hand, Engaging one or more fingers neighbouring the one or more fingers on which the device is mounted with the clamp so as to place the clamp in an open position (h1), Maintaining the open position (h1) of the clamp and simultaneously placing a tool between the clamping surfaces of the clamp, Placing the clamp in the closed position (h2), whereby the tool is retained in the clamp, By this method it is possible to operate the tool holder mounted on the back of a hand, by the fingers on the same hand on which the device is mounted, e.g. the free fingers neighbouring the fingers enclosed by the mounting member, and thereby the other, second hand of the user may solely be used for placing the tool between the clamping surfaces. Advantageously, this allows for an easy and quick way of securing a tool to the device and hand, or replacing a tool with another tool, with large control of both the clamp and the tool.

For removing the tool, the same method is used, except that the tool is removed from the clamp while maintaining the open position (h1). The tool may be removed by the other, free hand of the user, or the hand on which the device is mounted may be simply flipped or rotated, e.g. so as to drop the tool due to the gravitational force.

In one or more embodiments of the third aspect of the invention, the device is a device according to any of the embodiments of the first aspects of the invention. The device may comprise any of the features and advantages described in relation to the first aspect of the invention.

Preferably, the device is securely mounted on the back of the hand, around e.g. two neighbouring fingers such as the third and the fourth fingers, hereafter the clamp is preferably placed into the open position (h1), e.g. by means of one or more engagement member, or by directly applying a force on the clamp by the finger so as to separate the clamping surfaces and e.g. increase the clamp opening(s) and/or the interior clamp space, whereby a tool can be placed in the clamp between the clamping surfaces and e.g. in the interior clamp space. As the force is released on the clamp, the clamp will tend to recover to its original closed position (h2) i.e. original separation spacing of the clamping surfaces and e.g. size of opening and/or interior space, thus applying and inward force on the tool placed in the clamp, if the tool width is larger than the original separation spacing. The width of the clamp opening and the width of the clamp space may be continuously increased as the clamp wall is continuously moved away from the centre of the interior clamp space. The movement of the clamp wall may be stopped when the clamp opening and clamp space is big enough to receive the tool. Padding may be provided in the interior clamp space for aiding in holding particularly small tools.

The invention also relates to the use of the device according to any of the embodiments of the first aspect of the invention for aiding in or executing tasks within the everyday life or within the field of arts, handicrafts, and trades such as carpentry, woodworking, tapestry, metalwork, pottery making, painting, paper craft, cosmetic treatment or the like.

The invention further relates to the use of a device according to any of the embodiments of the first aspect of the invention for mounting a tool onto a hand of a user. The tool may be mounted on the hand via the device. The device may be used directly on the finger(s) or the device may be used on top of a glove. The device may be used on either the left or the right hand.

The invention further relates to the use of a device according to any of the embodiments of the first aspect of the invention with a tool such as a flashlight, pen or knife for a specific task. The device mounted on a hand with e.g. a pen may be used in e.g. measuring and marking positions for hanging pictures, where the user may readily switch to and from drawing drill marks using the pen mounted in the device. The pen may be used while the user is also holding a measuring tool, such as spirit level for measuring e.g. distances and/or levels. All or some of the fingers of the hand on which the device is mounted may assist in holding the measuring device while marks are drawn by the pen via the finger(s) on which the device is mounted. A soldering iron may alternatively be mounted in the device and used for soldering objects together e.g. wires, while the hands of the user are arranging/holding the objects to be soldered together. Alternatively, a knife may be mounted in the device for cutting an object at a desired length or shape while the user is simultaneously measuring the object using a measuring tool. The device may also be used by a cosmetician for beauty treatments, where the device is used in storing cosmetic products such as powders, eye shadows, dyes etc. or the device is used with a brush mounted in the clamp.

FIGURES

Aspects of the present disclosure will be described in the following with reference to the figures in which:

FIG. 1*a* shows a side view of the device with the clamp in the closed position (h2).

FIG. 1*b* shows a side view of the device with the clamp placed in the open position (h1).

DETAILED DESCRIPTION

Figure 1A:
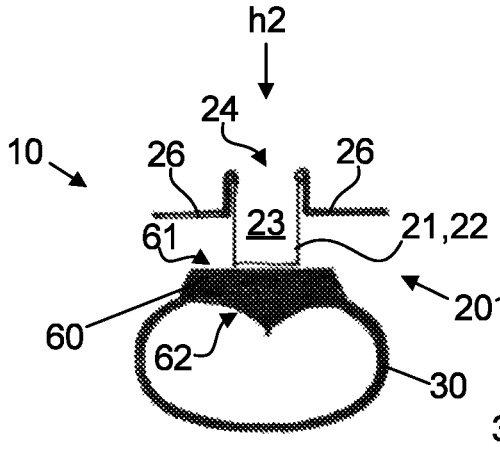

FIG. 1*a* shows a device 10 according to embodiments of the invention, seen from the side. The device 10 is shown comprising a mounting member 30 and a receiving part 20, where the receiving part 20 comprises a clamp 21 having a clamp wall 22 enclosing an interior clamp space 23 accessed through a clamp opening 24 and the receiving part further comprises two engagement members 26. The clamp 21 is shown in an unbiased closed position (h2) in which no force is applied to the engagement member 26 or the clamp 21.

Figure 1B:
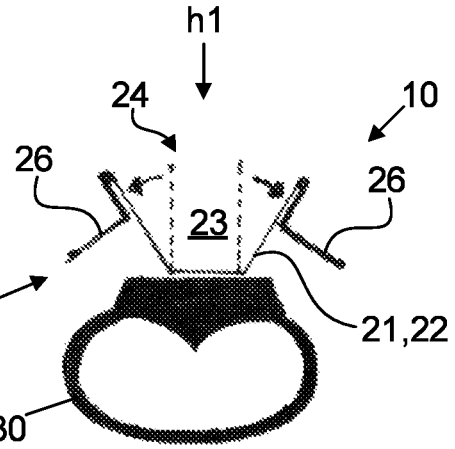

In FIG. 1*b*, the clamp 21 of the device shown in FIG. 1*a* is shown being biased and placed in the open position (h1). In the present example, the clamp 21 is configured to be placed in the open position (h1) by separating two opposing parts of the clamp wall 22 as indicated by the arrows, such that the interior space 23 and the size of the clamp opening 24 are increased. This separation is provided via the engagement members 26. This is possible as the clamp wall 22 comprises at least one elastic part. The increased clamp opening 24 to the interior space 23 of the clamp 21 is configured to be large enough for a tool 40, such as a hand tool 40, to be moved through the opening 24 and placed in the interior space 23.

The elasticity of the elastic part(s) of the clamp wall 22, provides the clamp 21 with the ability to restore its original configuration after deformation, i.e. after the force on the clamp wall 22 is released. The restoring force of the elastic part(s) will force the clamp wall 22 towards its original position. The original position is indicated by dotted lines.

In FIG. 1*a*, 1*b*, 2-4, 6-7 the mounting member 30 is shown as being configured to enclose two neighbouring fingers 16, the mounting member 30 extends substantially all the way around the enclosing fingers 16. The mounting member 30 comprises a longitudinal void having two opposing mounting member openings allowing at least a part of the hand 15, such as two fingers 16, to extend through the mounting member 30 (shown in FIGS. 6 and 7). In FIGS. 1*a*, 1*b* and 2-4, the mounting member 30 comprises a support region 60, on which the receiving part 20 is fixed. In the present examples, the support region 60 is situated directly below the clamp 21 and provides a rigid connection between clamp 21 and the mounting member 30. The support region 60 has a lower support region surface 62 facing a remaining part of the mounting member 30 and an upper support region surface 61 facing the clamp 21. The lower surface 62 is in the present examples curved to a shape substantially fitting the surface shape of two neighbouring fingers 16 on the dorsum side of a hand 15 on which the device is to be mounted. The lower surface shape 62 is substantially m-shaped whereby the middle region of the surface shape 62 comprises a protruding wedge adapted to extend a distance down in between the fingers 16 on which the device 10 is to be mounted, and provides additional support especially against rotation of the mounting member 30 around the longitudinal extent of the fingers 16.

FIG. 1*a*, 1*b*, 2-3, 6-7 shows embodiments of the device 10 comprising a clamp 21 made of a plate-material such as spring steel strip providing a clamp wall 22 bent into a U-shape. The U-shape encloses an interior clamp space 23, and provides a clamp opening 24 directed away from the mounting member 30 and the dorsum side of the hand 15. The U-shaped clamp wall also provides two clamp openings 24 at two opposing sides of the clamp 21, these side clamp openings 24 each have an extent of the opening arranged perpendicular to the dorsum side of the hand 15, when the fingers 16 are in a stretched out configuration. These side openings 24 are additionally also substantially parallel to the two opposing mounting member openings of the mounting member 30.

The engagement member 26 of the device 10 may be made from one or more plates, or rods of rigid material. In the embodiments of the device 10 shown in FIGS. 1*a*, 1*b*, 2, 3, 6 and 7 the device 10 comprises two engagement members 26, which are each attached to a side of the clamp 21 onto the outside of the clamp wall. In the present examples, the engagement member 26 is shaped such as to create a generally L-shaped engagement member 26 when viewed from the side, having at least two parts arranged at a right angle to each other. The first part of each engagement member 26 is attached to a part of the outside of the clamp wall 22, preferably at the upper part of the clamp wall 22 near the clamp opening 24. The second part of each engagement member 26 is extending sideways in a direction away from the clamp 21 and towards a position above a finger 16 neighbouring a finger 16 on which the device 10 is mounted. In the present examples, the engagement members 26 are arranged in a substantially symmetric configuration about an axis extending outwardly from the centre of the clamp opening 24. The engagement members 26 may in other examples have different shapes, for example for accommodating different mobilities of the neighbouring fingers 16 while still being arranged to facilitate the transfer of the necessary bias on the clamp 21.

Figure 2:
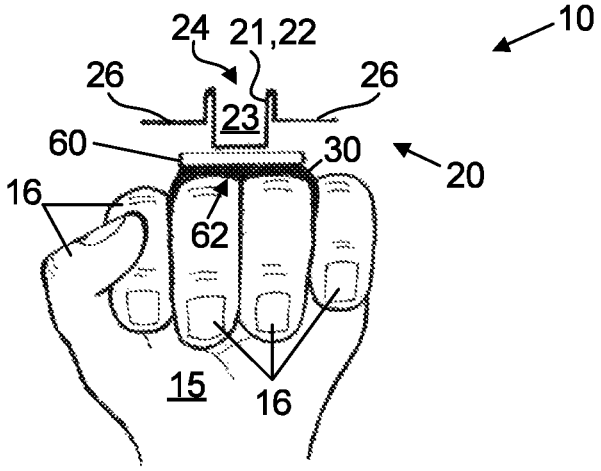
FIG. 2 shows a side view of the device with the clamp in the closed position (h2), where the device is mounted on a hand.

FIG. 2 shows a device 10 according to embodiments of the invention, seen from the side and arranged on a hand 15 of a user. The device 10 is mounted on the third and fourth fingers 16 of the hand 15, and the clamp 21 is in an equilibrium state in the closed position (h2) where the clamp 21 is not being biased by the fingers 16.

Figure 3:
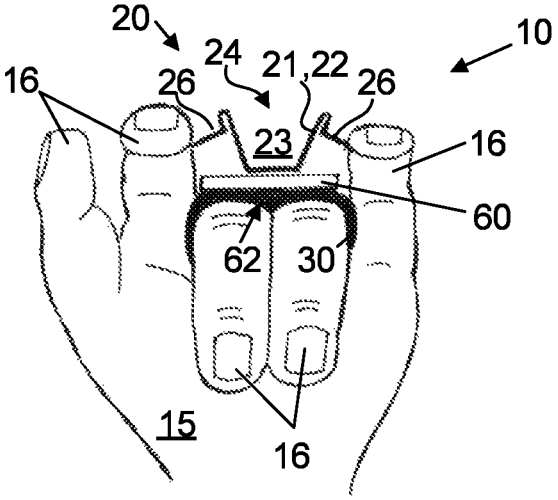
FIG. 3 shows a side view of the device with the clamp placed in the open position (h1) by two fingers of the hand on which the device is mounted.

FIG. 3 shows a device 10 according to embodiments of the invention, seen from the side and arranged on a hand 15 of a user. The device 10 is mounted on the third and fourth fingers 16 of the hand 15, and the clamp 21 comprises elastic parts so that when the clamp 21 is being biased by the second and fifth fingers 16 of the hand 15 as shown, the clamp 21 is deformed and placed in the open position (h1). The open position (h1) of the clamp 21 provides an increase in the extents of the clamp openings 24, at the top and on the sides of the clamp 21. Furthermore, the interior clamp space 23 is also increased. In this configuration of the clamp 21, a tool 40 or object of a suitable size can be placed in the interior space 23 and rest on the base of the clamp 21 near the support region 60.

Figure 4:
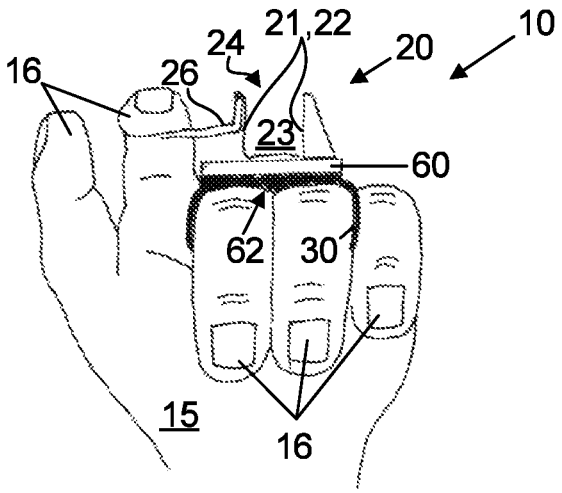
FIG. 4 shows a side view of the device with the clamp placed in the open position (h1) by one finger of the hand on which the device is mounted.

FIG. 4 shows a device 10 according to embodiments of the invention, seen from the side and arranged on the third and fourth fingers 16 of the hand 15. In the present example, the device 10 comprises a clamp 21, having a clamp wall 22, comprising of a rigid part and a flexible part and enclosing an interior clamp space 23 accessed through a clamp opening 24, comprising an upper clamp opening and two side clamp openings. The side openings 24 are additionally also substantially parallel to the two opposing mounting member openings of the mounting member 30. The flexible part of the clamp is in the present example, made of spring steel strip, bent to form the interior space in cooperation with the rigid part of the clamp. The rigid part may be made of hard plastic or metal or other rigid material. One engagement member 26 is attached to an outside part of a part of the clamp 21 in direct connection to the flexible part of the clamp wall 22, such that when the engagement member 26 is moved at least a section of the flexible part of the clamp wall 22 is also moved. The second finger 16 of the hand 15 is shown in engagement with the engagement member 26 and applying a force on the engagement member 26 in a direction towards the palm of the hand 15 in order to place the clamp 21 in the open position (h1).

Figure 5:
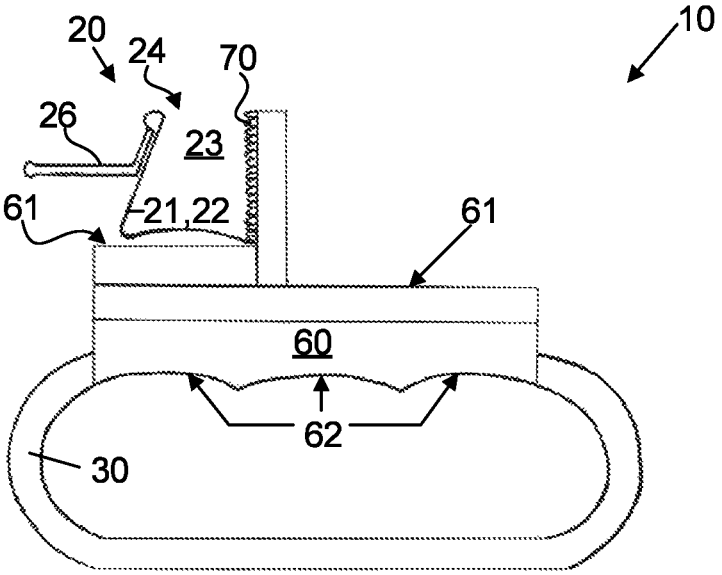
FIG. 5 shows a side view of the device with the clamp and with a mounting member configured to mount the device around three fingers of the hand.

FIG. 5 shows a device 10 according to embodiments of the invention, seen from the side. The device comprises a clamp 21 similar to the clamp 21 shown in FIG. 4. The clamp 21 is shown comprising padding 70 in the interior space 23 of the clamp 21, attached to the rigid part of the clamp wall 22. The padding 70 aids in securing a tool 40 in the clamp 21. The mounting member 30 in FIG. 5 is configured to fully enclose three fingers 16 of the hand 15, such as the third, fourth and fifth finger 16, whereby the second finger 16 may be used to bias the clamp 21. The mounting member 30 may also be arranged around the second, third and fourth finger 16, such that the engagement member 26 is operated by the first finger 16 or the fifth finger 16. The mounting member 30 is shown comprising a support region 60 with the lower support surface 62 having a shape complementing an upper surface shape of three neighbouring fingers 16. The thickness of the support region 60 depends on the desired position of the tool 40 relatively to the hand 15. A larger thickness may in turn provide a larger stability of the device 10 when in use.

Figure 6:
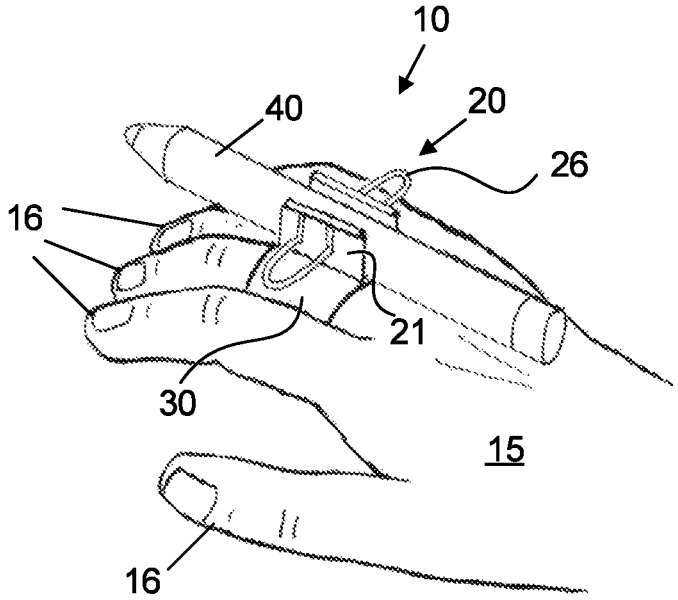
FIG. 6 shows a perspective view of a pen mounted in the receiving part of the device mounted on a hand.

FIG. 6 illustrates a device 10 according to embodiments of the invention, seen in perspective. The device 10 comprises a mounting member 30 which is shown mounted around two neighbouring fingers 16, the third and the fourth finger 16, at the proximal parts of the fingers 16, between joints of the fingers 16. The present exemplary device 10 comprises two engagement members 26 attached to the clamp 21.

In the present example, each engagement member 26 is shaped from a single metal rod, bent into a U-shape having two free rod ends, where the free ends are bent at a right angle, such as to create a generally L-shaped member when viewed from the side. The ends of the engagement member 26 are each attached to a part of the outside of the clamp wall 22, preferably the rod ends are at least attached to the upper part of the clamp wall 22 near the clamp opening 24. The opposite end of each engagement member 26, i.e. the bent part of the rod, creating a semi-circular shape is extending sideward, away from the clamp 21 and towards a position above a finger 16 neighbouring a finger 16 on which the device 10 is mounted.

A tool 40, which in the present example constitutes a pen, is mounted in the receiving part 20, within the interior space 23 of the clamp 21 and retained herein by two opposed clamping surfaces 25, which in the present example are a part of the clamp wall 22. In the present example, a pen is placed between the clamping surfaces 25, and since the width of the pen is larger than the original spacing between the clamping surfaces 25, the pen will be affected by the restoring force, and the restoring force will result in a holding force applied on the pen. The pen is thereby fixed to the dorsum of the hand 15 and may be used by moving the hand 15.

Figure 7:
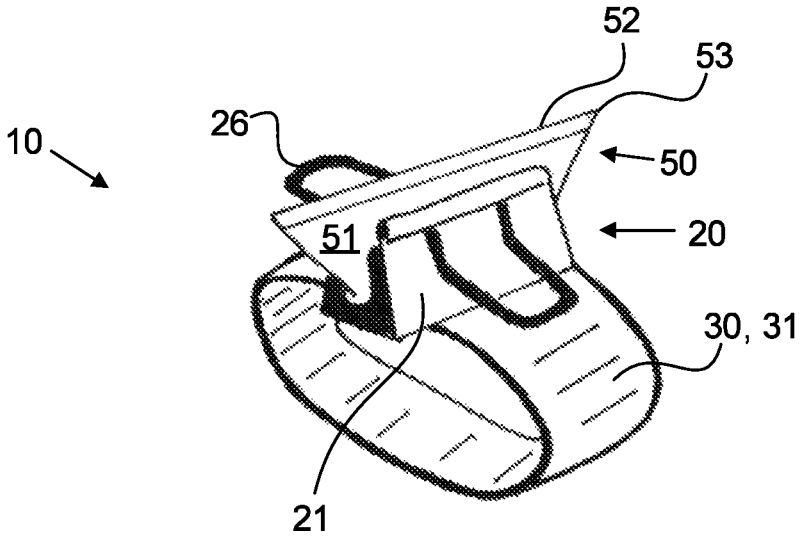
FIG. 7 shows a perspective view of a knife blade mounted in the receiving part of the device.

FIG. 7 shows a device 10 according to embodiments of the invention, seen in perspective. A knife tool 50 is shown mounted in the interior clamp space 23 of the clamp 21 between opposing parts of the clamp wall 22. The knife tool 50 comprises a knife blade 51 having a cutting edge 52 at the upper edge of the blade 51 directed away from the device 10. The knife blade 51 is substantially shaped as a trapezoid and arranged in the clamp 21 such that the knife blade 51 comprises a knife point 53 at the corners of the blade furthest away from the clamp 21. The knife blade 51 is arranged such that it can be removed by applying a downward force on the engagement member(s) 26, which will deform the clamp wall 22 and release the pressure on the knife blade 51, whereby it can be removed. The mounting member 30 is in the present example a strap, configured to fully enclose one or two fingers 16.

The device may be used in everyday or work tasks and provides the user with larger functionality equivalent to having an extra helping hand, such that the task can be executed in a more efficient way. A user may e.g. want to execute a task such as accessing and emptying a narrow space with one of the user's hands 15. The device 10 with a tool 40 such as e.g. a flashlight mounted in the device 10, may be mounted on the same hand 15 dedicated for executing the task, and used for illuminating an area directly extending beyond the fingertips, when the fingers 16 are stretched out, while executing the task. Due to the generally small size of the device 10 the hand 15 with the device 10 can access small and narrow spaces.

The device 10 shown in FIG. 6 with a pen mounted in the receiving part 20 can be used to mark objects to be operated on, such as marks indicating areas to be cut. By creating a first with the hand 15, the pen tip extends beyond the hand 15 and may be used to create a mark by moving the wrist. Parts of the same hand 15 may simultaneously be used for another purpose e.g. for holding the object being marked etc.

The device as shown in FIG. 7 can be used for cutting substantially thin objects, such as cardboard, paper, wire, string, tape etc., by making a stroke with the hand 15 on which it is mounted. A powerful stroke can generally be made using both power generated from the wrist and the arm. The movement of the wrist from the area near the dorsum side of the hand 15 to an area near the palm side of the hand 15 or vice versa can generate a clean and powerful cut applicable in many work tasks.

The device 10 according to examples may also be used to store a tool 40 or object on the hand 15 until it is needed.

The method of attaching a tool 40 to the hand 15 of a user, by mounting it in the receiving part 20 comprises the steps of mounting the finger-mountable device onto one or more fingers 16 of a hand 15 of the user via the mounting member 30, and then mount the tool 40 in the receiving part 20 or vice versa. The receiving part 20 facilitates placing the tool 40 in the clamp 21, by having elastic clamp part(s), which is biased so as to increase the clamp space 23 as one or more fingers 16 of the hand 15 of the user is engaging with the one or more engagement member(s) 26, and then applying a force in a direction away from dorsum side of the hand 15, which transfers the engagement member(s) 26 from a non-activated position into an activated position and simultaneously transfers the clamp 21 into the open position (h1). As the open position (h1) is maintained a tool 40 is placed in the clamp 21. As the force on the engagement member(s) 26 is released, the engagement member 26 and the clamp 21 move back towards the non-activated position and the closed position (h2) respectively, whereby the tool 40 becomes stuck in the clamp 21 due to the inward pressure on the tool 40 from the restoring force generated by the elastic clamp 21 part.

REFERENCES

10 Device
15 Hand of the user
16 Finger of the hand of the user
20 Receiving part
21 Clamp
22 Clamp wall
23 Interior clamp space
24 Clamp opening
25 Clamping surfaces
26 Engagement member
30 Mounting member
31 Band of metal e.g. aluminium band
32 Hook and loop fastening strap
40 Tool
50 Knife tool
51 Knife blade
52 Cutting edge
53 Point of the knife tool
60 Support region
61 Upper support region surface
62 Lower support region surface
70 Padding
h1 Open position of the clamp
h2 Closed position of the clamp

What is claimed is:

1. A finger-mountable device for mounting a tool on two neighboring fingers of a hand of a user, the device comprises a receiving part for attachment of a tool and at least one mounting member for mounting the device on two neighboring fingers of the hand of the user, wherein the receiving part is fixed to the mounting member, and the receiving part comprises:

at least one clamp for clamping a tool to the device and at least one engagement member, wherein the at least one clamp has a closed position and an open position, and wherein the at least one engagement member is made of a rigid material and extends laterally outward from a clamp wall providing at least one moment arm, such that the at least one clamp is operable via the engagement member into the open position and the closed position by the one or more fingers of the same hand the device is mounted on, the mounting member comprises a support region extending over at least a part of the two neighboring fingers, when the device is mounted thereon, and wherein the support region comprises a protruding part fully extending in between the neighboring fingers, when the device is mounted thereon, so as to prevent rotation of the mounting member about an axis parallel to the longitudinal direction of the neighboring fingers.

2. The device according to claim 1, wherein the device is configured to be mounted on the proximal finger parts of at least two neighboring fingers.

3. The device according to claim 2, wherein the at least one clamp is configured to be biased into the open position by using at least one finger which is neighboring at least one of the fingers on which the device is mounted.

4. The device according to claim 2, wherein the at least one clamp comprises at least two opposing clamping surfaces for retaining the tool in the device, and wherein the at least one clamp is configured to be biased into the open position by separating the clamping surfaces by using at least one finger which is neighboring at least one of the fingers on which the device is mounted.

5. The device according to claim 2, wherein the engagement member is positioned such that it is reachable by a finger, neighboring at least one of the fingers on which the device is mounted.

6. The device according to claim 1, wherein the engagement member is configured to be angularly moved about a pivotal point whereby the at least one clamp is placed in the open position.

7. The device according to claim 1, wherein the at least one clamp of the receiving part consists of only one clamp, and the at least one engagement member of the receiving part consists of two of the engagement members.

8. The device according to claim 1, wherein the at least one clamp comprises at least two opposing clamping surfaces for retaining the tool in the device, and wherein each clamping surface is configured to be moved via the at least one engagement member.

9. The device according to claim 1, wherein the at least one clamp is configured to clamp a knife tool to the receiving part and wherein the knife tool comprises a knife blade having a cutting edge.

10. The device according to claim 9, wherein the knife tool is mounted such that at least a point of the cutting edge of the knife blade is exposed and directed forwardly towards the tip of the fingers of the hand on which the device is mounted when the fingers are stretched out.

11. The device according to claim 1, wherein the mounting member comprises a band of plastic or metal, which is bent to sufficiently enclose one or more fingers.

12. The device according to claim 1, wherein the mounting member comprises a strap for securing the device onto one or more fingers of the user.

13. The device according to claim 12, wherein the strap is a hook and loop fastening strap.

14. The device according to claim 12, wherein the strap is a flexible strap.

15. The device according to claim 1, wherein the mounting member encloses at least a part of proximal finger parts of two neighboring fingers.

16. The device according to claim 1, wherein the support region extends along a direction parallel to a transverse plane dividing the mounting member and the receiving part.

17. A method for retaining a tool to a device, comprising:

providing the device comprising:

a mounting member for fixing the device on one or more fingers and a receiving part for holding the tool, wherein the receiving part is fixed to the mounting member, and the receiving part comprises at least one clamp for clamping a tool to the device, the at least one clamp comprises:

at least two clamping surfaces, and an open position and a closed position, wherein in the open position the at least one clamp facilitates placing a tool into the at least one clamp or removing a tool from the at least one clamp, and wherein the closed position facilitates securely retaining the tool in the receiving part, and wherein the receiving part further comprises at least one engagement member made of a rigid material and providing at least one moment arm attached to the at least one clamp, such that the at least one clamp is operable via the engagement member into the open position and the closed position by one or more fingers of the same hand the device is mounted on, mounting the device on one or more fingers of a hand of the user via the mounting member, such that the receiving part is positioned on the dorsum side of the hand, engaging one or more fingers neighboring the one or more fingers on which the device is mounted with the at least one clamp so as to place the at least one clamp in an open position, maintaining the open position of the at least one clamp and simultaneously placing a tool between the clamping surfaces of the at least one clamp, placing the at least one clamp in the closed position, whereby the tool is retained in the at least one clamp.

18. A method for retaining a tool to a devise comprising a receiving part for attachment of a tool and at least one mounting member for mounting the device on two neighboring fingers of the hand of the user, wherein the receiving part is fixed to the mounting member, and the receiving part comprises:

at least one clamp for clamping a tool to the device and at least one engagement member, wherein the at least one clamp has a closed position and an open position, and wherein the at least one engagement member is made of a rigid material and extends laterally outward from a clamp wall providing at least one moment arm, such that the at least one clamp is operable via the engagement member into the open position and the closed position by the one or more fingers of the same hand the device is mounted on, the mounting member comprises a support region extending over at least a part of the two neighboring fingers, when the device is mounted thereon, and wherein the support region comprises a protruding part fully extending in between the neighboring fingers, when the device is mounted thereon, so as to prevent rotation of the mounting member about an axis parallel to the longitudinal direction of the neighboring fingers, wherein the method comprises:

mounting the device on one or more fingers of a hand of the user via the mounting member, such that the receiving part is positioned on the dorsum side of the hand, engaging one or more fingers neighboring the one or more fingers on which the device is mounted with the at least one clamp so as to place the at least one clamp in an open position, maintaining the open position of the at least one clamp and simultaneously placing a tool between the clamping surfaces of the at least one clamp, placing the at least one clamp in the closed position, whereby the tool is retained in the at least one clamp.

19. A method of use of a device comprising:

providing the device, wherein the device comprises a receiving part for attachment of a tool and at least one mounting member for mounting the device on two neighboring fingers of a hand of an user, wherein the receiving part is fixed to the mounting member, and the receiving part comprises at least one clamp for clamping a tool to the device and at least one engagement member, wherein the at least one clamp has a closed position and an open position, wherein the at least one engagement member is made of a rigid material and extends laterally outward from a clamp wall thereby providing at least one moment arm, such that the at least one clamp is operable via the engagement member into the open position and the closed position by the one or more fingers of the same hand the device is mounted on, the mounting member comprises a support region extending over at least a part of the two neighboring fingers, when the device is mounted thereon, and wherein the support region comprises a protruding part fully extending in between the neighboring fingers, when the device is mounted thereon, so as to prevent rotation of the mounting member about an axis parallel to the longitudinal direction of the neighboring fingers, and mounting the tool onto the hand of the user.

* * * * *